US008808032B2

(12) United States Patent
Fischer et al.

(10) Patent No.: US 8,808,032 B2
(45) Date of Patent: Aug. 19, 2014

(54) MULTIPLE CABLE CONNECTOR

(71) Applicants: Charles Pitman Fischer, Marlton, NJ (US); Brian Faucher Miller, Chadds Ford, PA (US)

(72) Inventors: Charles Pitman Fischer, Marlton, NJ (US); Brian Faucher Miller, Chadds Ford, PA (US)

(73) Assignee: Cooper Technologies Company, Houston, TX (US)

( * ) Notice: Subject to any disclaimer, the term of this patent is extended or adjusted under 35 U.S.C. 154(b) by 33 days.

(21) Appl. No.: 13/627,800

(22) Filed: Sep. 26, 2012

(65) Prior Publication Data

US 2014/0085776 A1 Mar. 27, 2014

(51) Int. Cl.
*H01R 4/60* (2006.01)

(52) U.S. Cl.
USPC ..... 439/652; 439/215; 439/717

(58) Field of Classification Search
USPC ..... 439/928, 717, 215, 652, 484, 483, 364
See application file for complete search history.

(56) References Cited

U.S. PATENT DOCUMENTS

| | | | | |
|---|---|---|---|---|
| 4,085,996 | A * | 4/1978 | Koslo | 439/105 |
| 4,293,172 | A * | 10/1981 | Lingaraju | 439/105 |
| 5,941,720 | A * | 8/1999 | Byrne | 439/215 |
| 6,059,614 | A * | 5/2000 | Shelby et al. | 439/717 |
| 6,471,532 | B2 * | 10/2002 | Kondas et al. | 439/281 |
| 6,537,080 | B2 * | 3/2003 | Sato | 439/43 |
| 7,371,122 | B2 * | 5/2008 | Ivanova et al. | 439/652 |
| 7,544,076 | B2 * | 6/2009 | Lubkert | 439/215 |
| 7,690,953 | B2 * | 4/2010 | Boyd et al. | 439/717 |
| 7,905,737 | B2 * | 3/2011 | Byrne | 439/215 |
| 2009/0117776 | A1 * | 5/2009 | Kuo et al. | 439/484 |
| 2009/0239403 | A1 * | 9/2009 | Byrne | 439/215 |
| 2010/0190369 | A1 * | 7/2010 | Byrne | 439/215 |
| 2011/0021050 | A1 * | 1/2011 | Byrne | 439/215 |
| 2011/0264328 | A1 * | 10/2011 | Brueggemann et al. | 701/41 |
| 2012/0045927 | A1 | 2/2012 | Panko et al. | |
| 2012/0220166 | A1 | 8/2012 | Fischer et al. | |

OTHER PUBLICATIONS

International Search Report and Written Opinion From Corresponding PCT Application No. PCT/US2013/060731, mailed Feb. 21, 2014 (9 pages).

Cooper Interconnect Product Catalog, "Harsh Evnironment Power Connectors, MIL-DTL-55181, MIL-DTL-12520 and Commercial Versions for Mid-Range Power Operations, © 2011", 40 pages.

* cited by examiner

*Primary Examiner* — Gary Paumen
(74) *Attorney, Agent, or Firm* — King & Spalding LLP

(57) ABSTRACT

A power or signal cable connector for allowing two or more electric devices to be connected to a single socket, the connector comprising: a shell having a first mounting block and a second mounting block; a nose piece assembly fastened to one end of the shell; a handle assembly fastened to an opposite end of the shell; a stud extending from the handle assembly through the nose piece assembly; and one of a cable adaptor and a socket/plug housing fastened to each of the first and second mounting blocks.

19 Claims, 12 Drawing Sheets

MULTIPLE CABLE CONNECTOR

TECHNICAL FIELD

The present invention relates generally to cable connector systems. More particularly, the present invention is directed to multiple cable mount power or signal connector for connecting multiple power or signal cables to a single power or signal source.

BACKGROUND OF THE INVENTION

Connectors are typically used to join a length of cable to a power source. Such connectors may be used in military applications, shipboard, for ground support, in airborne applications, in commercial industrial equipment and instrumentation, and other harsh environments. For example, military missions typically require the use of multiple radios for interoperable and tactical communications. Each radio is generally powered by a length of cable joined to a connector that is coupled to a power source. Conventional connectors allow for a single cable to be coupled to a power source. As a result, a different power source is needed for each radio. The use of multiple power sources for multiple cables in a single area results in wasted space and increased costs.

In some applications, a SINCGARS (Single Channel Ground and Airborne Radio System) may be installed in a vehicular adapter. FIG. 1 is an illustration of a vehicular adapter 18 mounted inside a tactical vehicle, wherein a radio 8 is mounted in vehicular adapter 10. The vehicular adapter may comprise a shock mount tray in which the radio is mounted. FIG. 2 illustrates a vehicular adapter 10 with a power/signal box 12. The vehicular adapter 10 may also comprise a power/signal box 12, which has a power input (A4J2) socket 14, a power output (A4J1) socket 20, a signal output (A4J4) socket 16 and a signal output (A4J3) socket 18. Each of these sockets has a nose piece assembly that has the desired pin contact or socket contact configuration. Power for the SINCGARS radio is typically supplied by the power output (A4J1) socket 20 of the power/signal box 12 of the vehicular adapter 10. A power cable of the radio is typically hard-wired or plugged to the power output (A4J1) socket 20. Further, when the radio is mounted in the vehicular adapter 10, heat dissipating fins extend from the back of the radio 8 directly over the power/signal box 12, so that space is limited above the sockets of the power/signal box 12. Because access is limited to the sockets of the power/signal box 12, it is not possible to configure presently available connectors to connect multiple cables to a single socket of the power/signal box 12.

Other applications also have limited space and access requirements. Panel mount pin connectors are typically used as the output power connection for SINCGARS and the panel mount socket connectors are used as the input power connection. 18-pin connectors are typically used as the audio/data connectors. The JTRS (Joint Tactical Radio System) radios use the same or similar connectors for power requirements. Connectors may be used in a wide variety of other power systems, surge suppression systems and control circuits.

Stacking connectors enable two radios or other devices to draw power from one source. However, some system configurations do not provide sufficient space around the power outlet to allow connectors to be vertically stacked.

Some connector solutions, like Dual Entry Connectors, do not allow an original cable to be connected to the connector. For example, when a Dual Entry Connector is used to connect both an original device and a second device to the same power source, the cable of the original device must be discarded and replaced with a cable compatible with the Dual Entry Connector.

Therefore, a need exists for an improved connector system that allows multiple cables to be coupled to a single socket of a power/signal box, while occupying minimal space.

SUMMARY OF THE INVENTION

The present invention satisfies the above-described need by providing primary connector systems that allow secondary connector systems to be coupled thereto. Thus, multiple power cables can be joined to a single power source. Dual entry connectors of the present invention enable power to be split from one source to two devices. In particular, a connector of the present invention provides for the connection of a second device's power cable to the power supply by allowing both the original device's power cable and the second device's power cable to be supplied power via the same connector, so that power may be supplied via the original cable of the original device.

According to one aspect of the invention, there is provided a connector comprising: a shell having a first mounting block and a second mounting block; a nose piece assembly fastened to one end of the shell; a handle assembly fastened to an opposite end of the shell; a stud extending from the handle assembly through the nose piece assembly; and one of a cable adaptor and a socket/plug housing fastened to each of the first and second mounting blocks.

A further aspect of the invention provides a connector comprising: a shell having a first mounting block and a second mounting block; a nose piece assembly fastened to one end of the shell; a handle assembly fastened to an opposite end of the shell; a means for securing the connector to a socket; a means for connecting a cable to the first mounting block; and a means for connecting a cable to the second mounting block.

According to another aspect of the invention, there is provided a communication system comprising: a vehicular adaptor comprising a power/signal box; a radio mounted to the vehicular adaptor and comprising a power cable; a connector comprising: a shell having a first mounting block and a second mounting block; a nose piece assembly fastened to one end of the shell; a handle assembly fastened to an opposite end of the shell; a stud extending from the handle assembly through the nose piece assembly; and one of a cable adaptor and a socket/plug housing fastened to each of the first and second mounting blocks, wherein the power cable of the radio is electrically connected to the connector via one of a cable adaptor and a socket/plug housing.

These and other aspects, objects, features, and embodiments of the present invention will become apparent to those having ordinary skill in the art upon consideration of the following detailed description of illustrative embodiments exemplifying the best mode for carrying out the invention as presently perceived.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features. Reference will now be made to the accompanying drawings, which are not necessarily drawn to scale, and wherein.

DETAILED DESCRIPTION OF THE INVENTION

Figure 1:
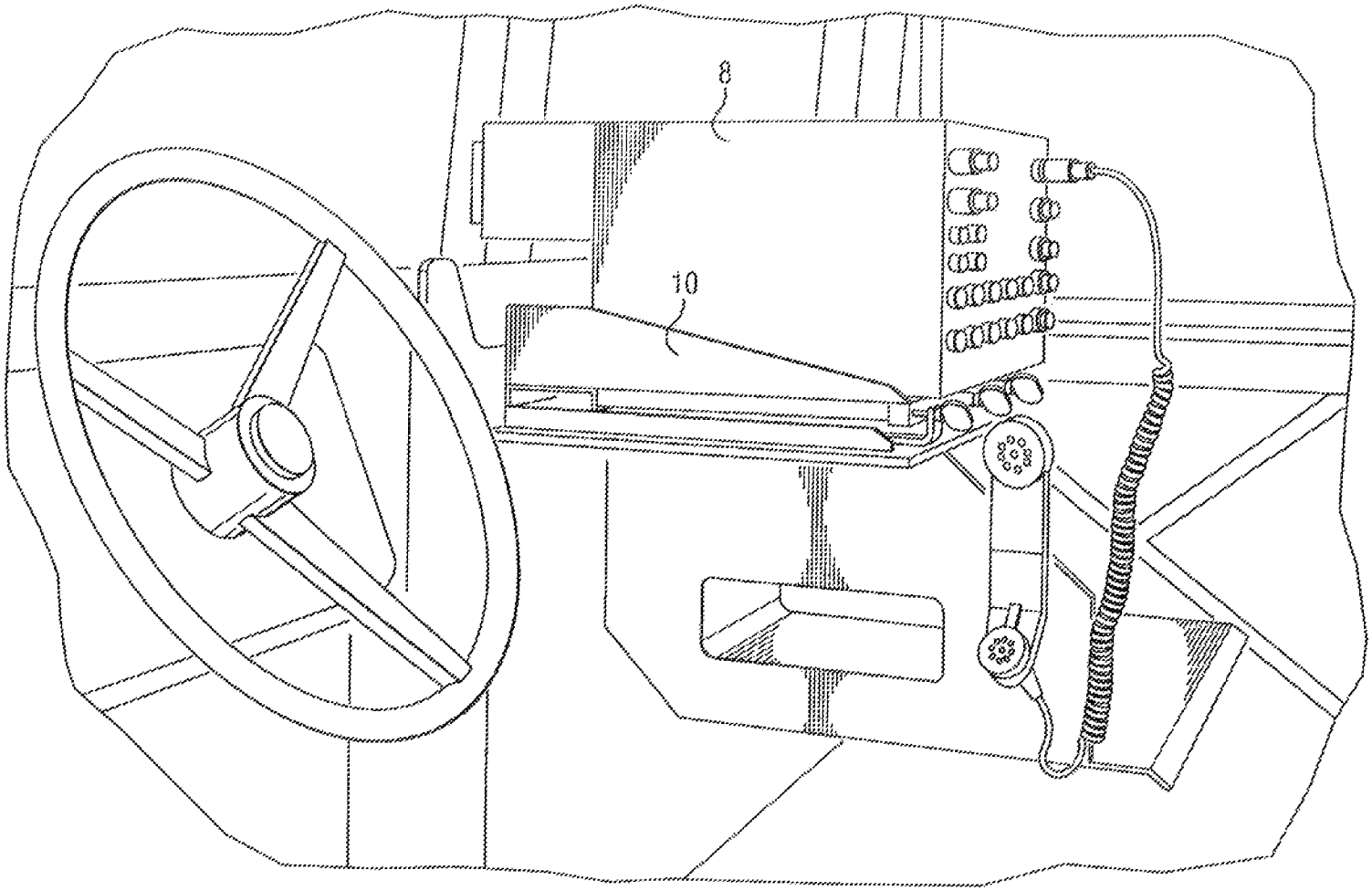
FIG. 1 (PRIOR ART)
FIG. 1 is a view of an interior of a vehicle, wherein a vehicular adapter is mounted in the vehicle for supporting a radio and other electric components.

A multiple cable connector described herein allows multiple cables to be coupled to a single socket. The connector is generally resistant to the effects of shock and vibration, and capable of withstanding the extreme range of environmental conditions encountered by ground support equipment. The connector also offers versatile configurations for virtually any military or industrial need.

The invention may be better understood by reading the following description of non-limitative, exemplary embodiments with reference to the attached drawings wherein like parts of each of the figures are identified by the same reference characters.

Figure 3:
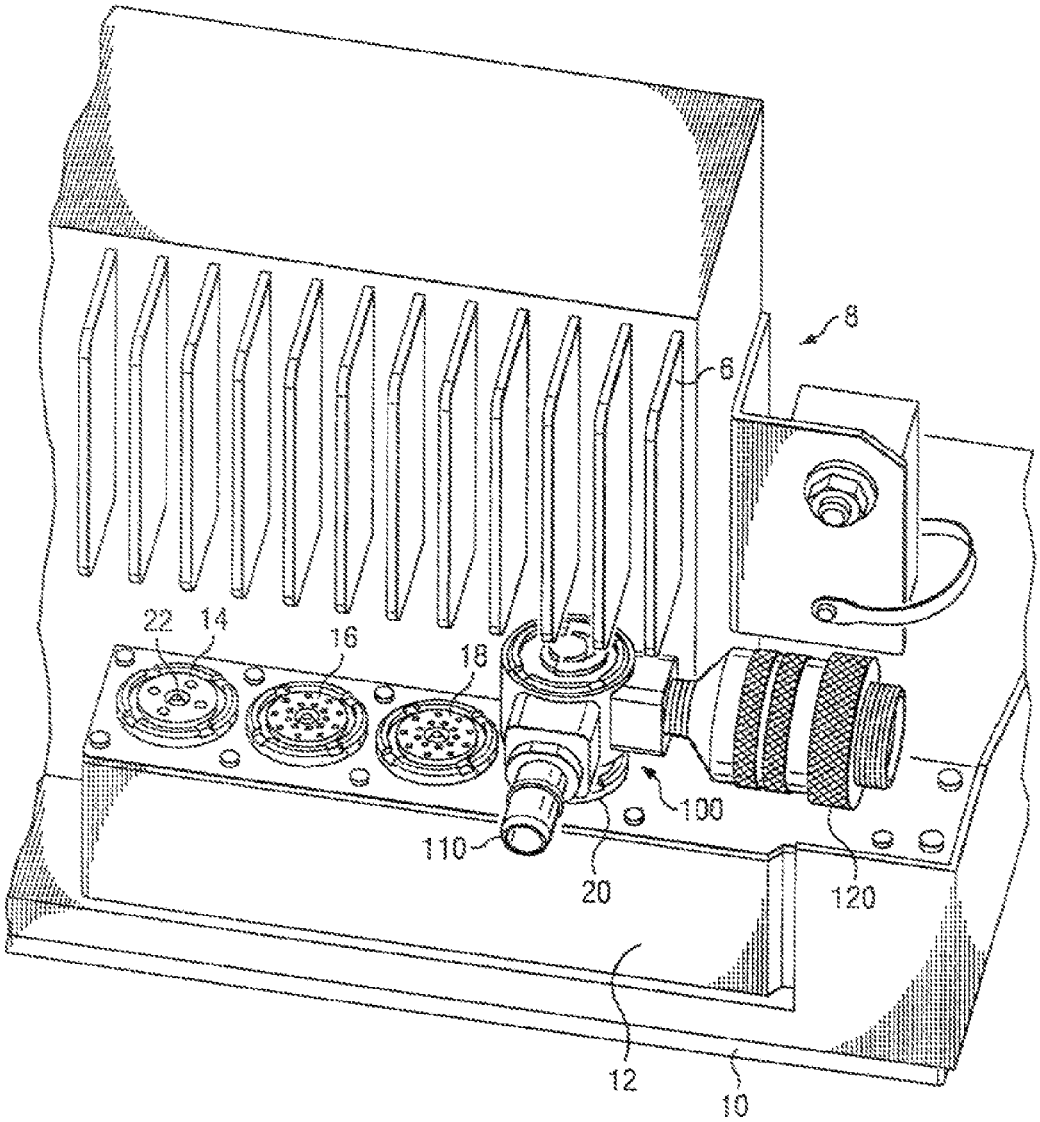
FIG. 3 is a back perspective view of a vehicular adapter with a power/signal box and a radio mounted in the vehicular adapter, wherein a connector is plugged into the power/signal box.

FIG. 3 is a perspective view of a back side of a vehicular adapter 10 having a power/signal box 12, wherein a radio 8 is mounted in the vehicular adapter 10 so that heat radiating fins 6 extend over the power/signal box 12. A multiple cable connector 100 of the present invention is shown plugged into the power output (A4J1) socket 20 of the power/signal box 12.

Figure 4A:
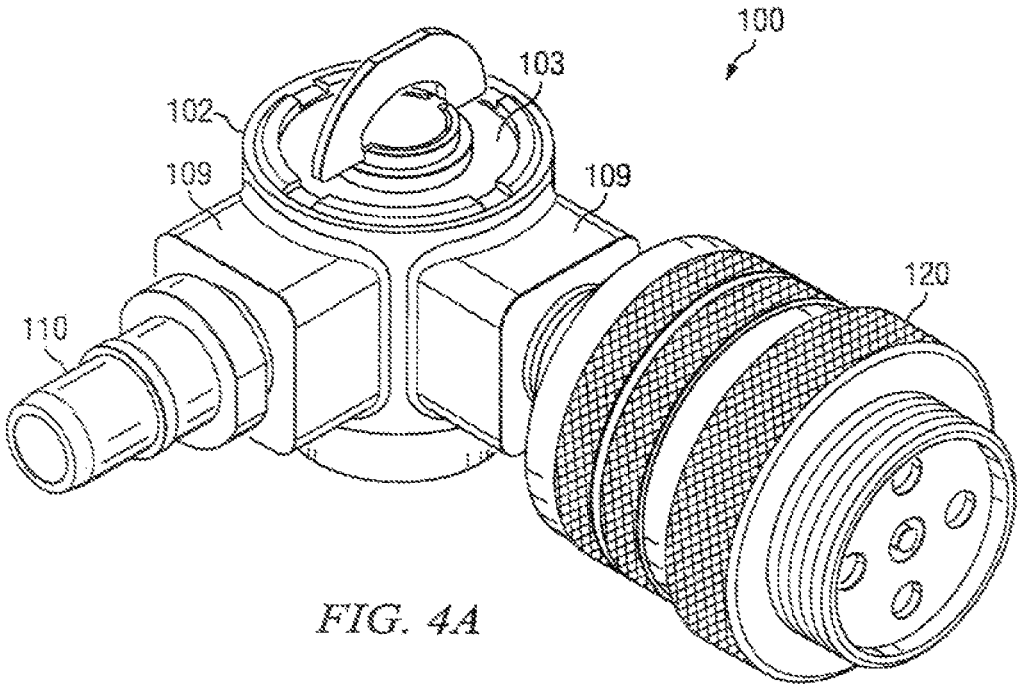
FIG. 4A is a top perspective view of a connector with a cable adaptor in one mounting block and a socket/plug housing in another mounting block, wherein a handle is visible at the top.
Figure 4B:
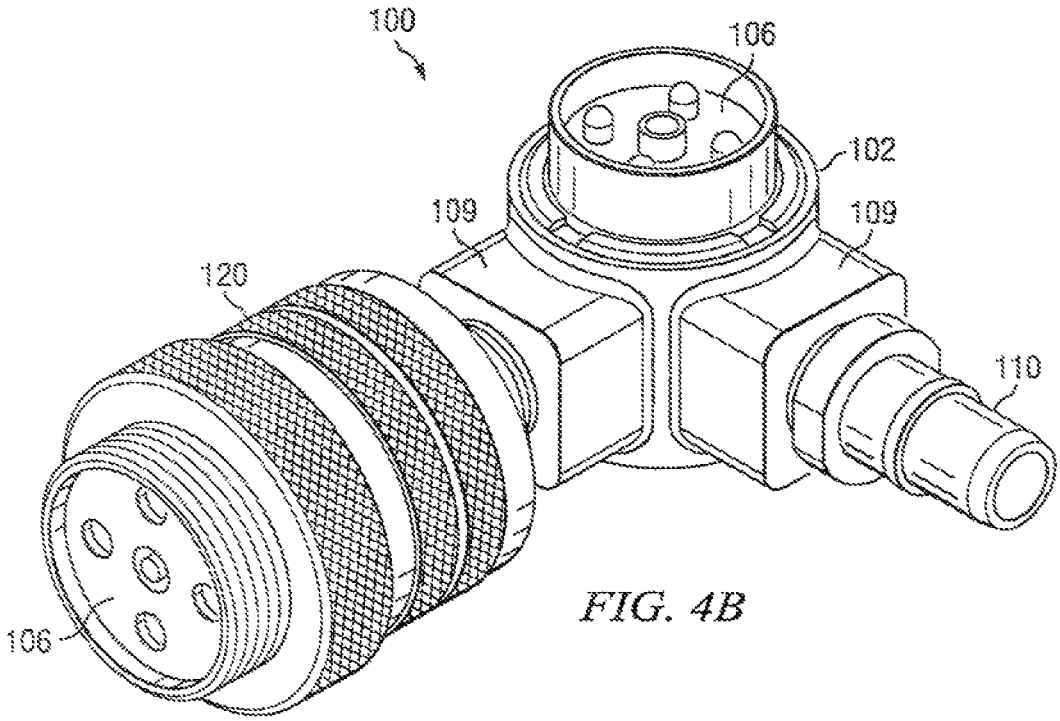
FIG. 4B is a bottom perspective view of the connector of FIG. 4A with a cable adaptor in one mounting block and a socket/plug housing in another mounting block, wherein a power nose piece assembly is visible at the bottom.

FIGS. 4A and 4B are top and bottom view, respectively, of a connector 100 of the present invention. The connector 100 comprises a shell 102, which serves as the structure for housing other components and for mounting components. The shell 102 comprises two mounting blocks 109. In the embodiment of the invention illustrated, a cable adaptor 110 is fastened to one of the mounting blocks 109 and a socket/plug housing 120 is fastened to the other mounting block 109. As shown in FIG. 4A, the connector 100 has a handle assembly 103, which is used to fasten the connector 100 to a socket after the connector 100 is plugged into a socket. As shown in FIG. 4B, the connector 100 has a nose piece assembly 106, which serves as the electrical interface between the connector 100 and the socket into which it is plugged. The nose piece assembly 106 may comprise female or male electrical connectors for either power or signal transmission. In the embodiment illustrated in FIG. 4B, the nose piece assembly 106 positioned in the shell 102 is a power plug with male contact pins. A second nose piece assembly 106 is positioned within the socket/plug housing 120. The nose piece assembly 106 positioned in the socket/plug housing is a power socket with female contact sockets.

Figure 5A:
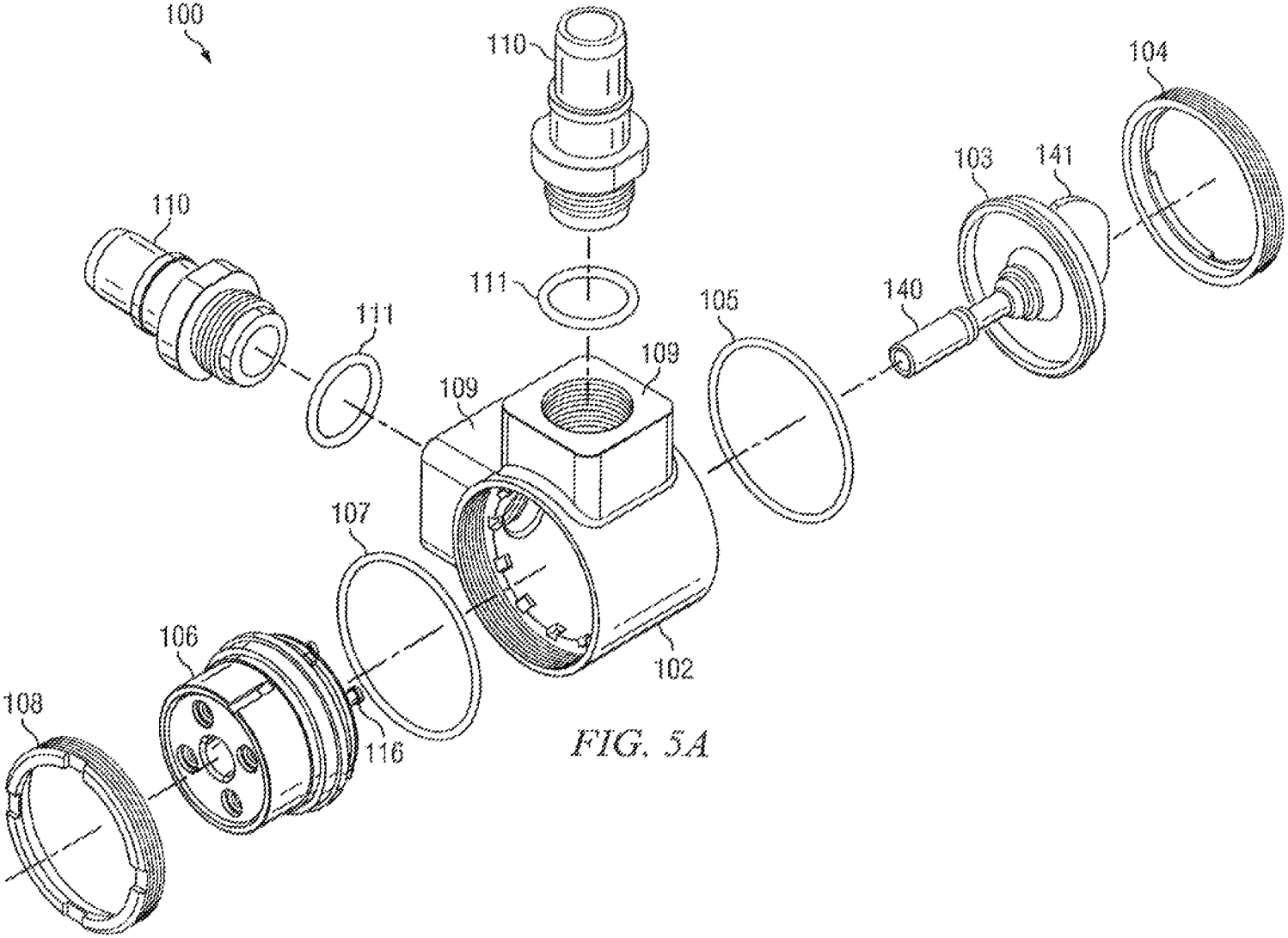
FIG. 5A is an exploded perspective view of a connector having a cable adaptor in each of two mounting blocks.

Referring to FIG. 5A, an exploded perspective view of a connector 100 is shown. The connector 100 has a shell 102 with two mounting blocks 109. In this embodiment, the shell 102 has a cylindrical structure and the mounting blocks 109 extend radially from the cylindrical structure at an angle of 90° from each other. Any angle may be used depending on the application, in particular, the angle between the mounting blocks may be between 0° and 180°, in particular between 55° and 180°. In the embodiment shown in FIG. 5, a cable adapter 110 is fastened into each of the mounting blocks 109. An adaptor o-ring 111 seals the connection between the cable adapter 110 and the mounting block 109. Into one end of the shell 102, a handle assembly 103 is inserted with a handle assembly O-ring 105 to seal the handle assembly 103 to the shell 102. A handle assembly spanner nut 104 is fastened to a threaded portion of the shell 102 to hold the handle assembly 103. At the opposite end of the shell, a nose piece assembly 106 is inserted with a nose piece o-ring 107. The nose piece assembly 106 has a diameter that is less than a diameter of the connector shell 102, and is at least partially positioned within the connector shell 102. The nose piece assembly 106 of the connector 100 is configured to mate with a power source. A nose piece spanner nut 108 fastens to a threaded portion of the shell 102 to hold the nose piece assembly 106. In this embodiment, the nose piece assembly 106 is a power socket with female electrical contacts.

To ensure that the connector 100 remains plugged into a socket while the radio and other components are bounced around by the vehicle in which they are mounted, the sockets 14-20 in the power/signal box 12 (see FIG. 3) have a draw screw 22. The draw screws 22 extend through the centers of the sockets or plugs, whichever the case happens to be in the power/signal box 12. The draw screws 22 have male threads. The connector 100 has a stud 140 that extends from the handle assembly 103, through the nose piece assembly 106. (see FIG. 5A) The distal end of the stud 140 has female threads for engagement with the male threads of a draw screw 22. Thus, when the connector 100 is plugged into a socket 14-20 of the power/signal box 12, the handle 141 of the handle assembly 103 may be rotated to turn the female threads of the stud 140 onto the male threads of the draw screw 22. Once the stud 140 is fully threaded onto the draw screw 22, the connector 102 may be firmly secured to the socket 14-20.

Figure 5B:
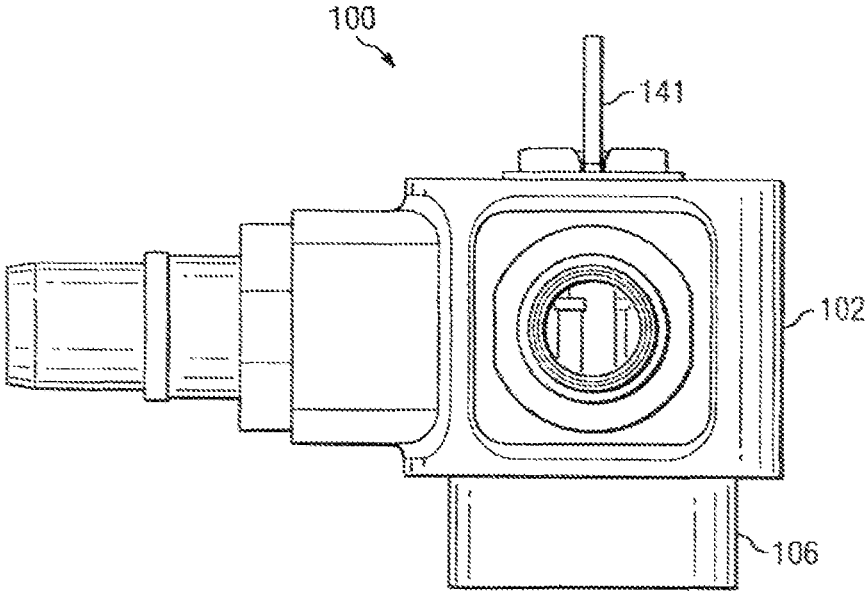
FIG. 5B is a side view of the connector of FIG. 5A, wherein the pin conductors of the nose piece assembly can be seen through a cable adaptor.
Figure 5C:
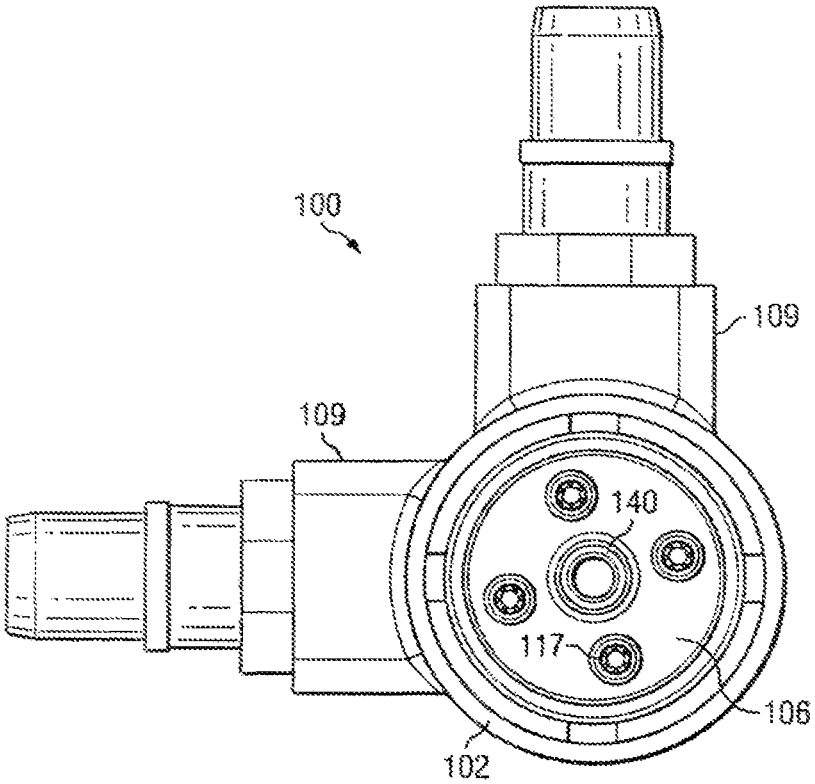
FIG. 5C is a bottom view of the connector of FIGS. 5A and 5B, wherein the nose piece assembly can be seen.
Figure 5D:
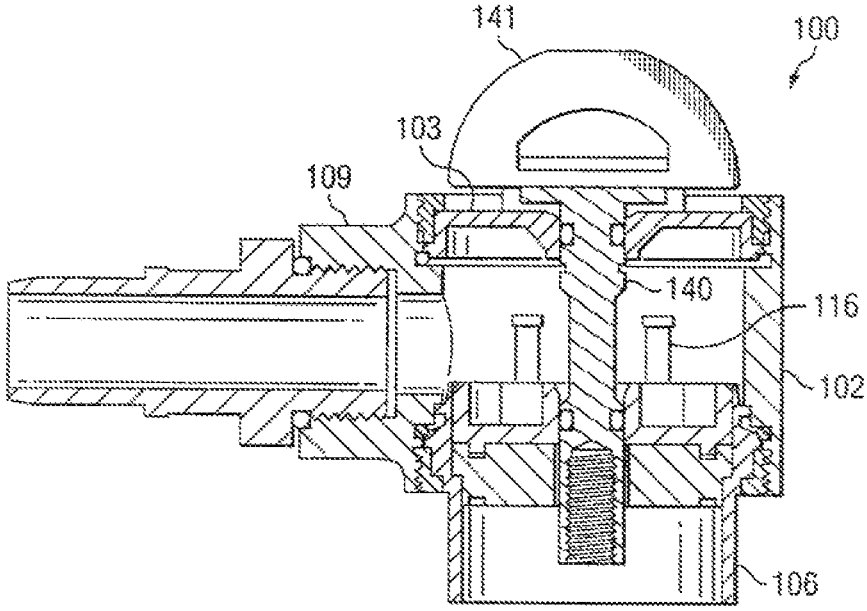
FIG. 5D is a cross-sectional side view of the connector of FIGS. 5A-5C, wherein the stud with female threads is visible extending from the handle assembly through the nose piece assembly.
Figure 5E:
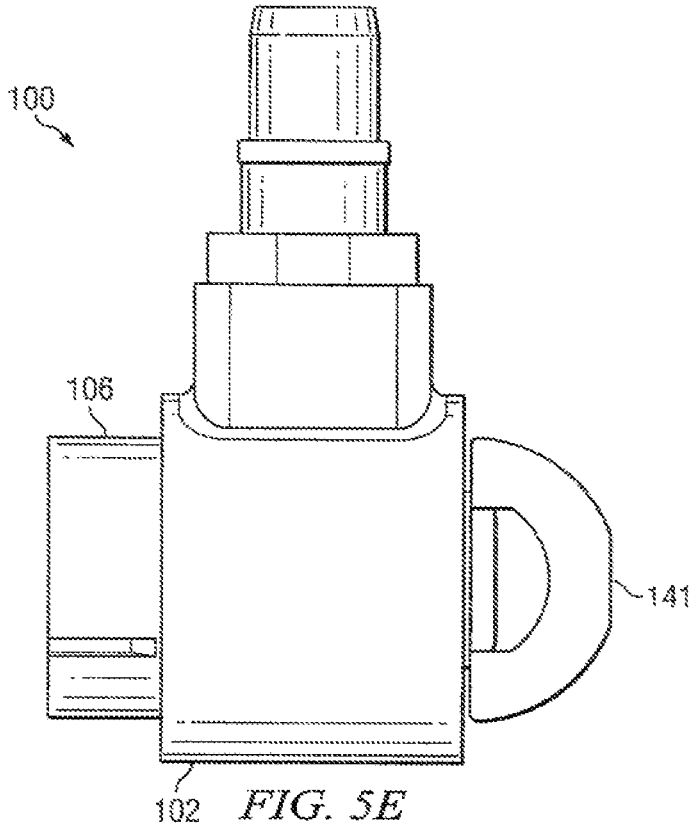
FIG. 5E is a side view of the connector of FIGS. 5A-5D, wherein the handle is visible.

FIG. 5B illustrates a side view of the assembled connector 100 of FIG. 5A. The handle 141 extends from the top of the shell 102 and the nose piece assembly 106 extends from the bottom of the shell 102. FIG. 5C is a bottom view of the connector 100 of FIGS. 5A and 5B. In this case, the nose piece assembly 106 is a female power socket. The stud 140 is visible in the center of the nose piece assembly 106. The mounting blocks 109 extend radially from the cylindrical shell 102 at an angle of 90° from each other. FIG. 5D is a cross-sectional side view of the connector 100 of FIGS. 5A-5C. The handle assembly 103 is assembled to the top of the shell 102 and the nose piece assembly 106 is assembled to the bottom of the shell 102. The connector 100 has a stud 140 that extends from the handle assembly 103, through the nose piece assembly 106, so that the female threads of the stud 140 are positioned to receive a draw screw 22 (see FIG. 3) of a socket or plug. FIG. 5D is an exterior side view of the connector 100 of FIGS. 5A-5D, wherein the handle 141 extends from the top of the shell 102 and the nose piece assembly 106 extends from the bottom of the shell 102.

Figure 2:
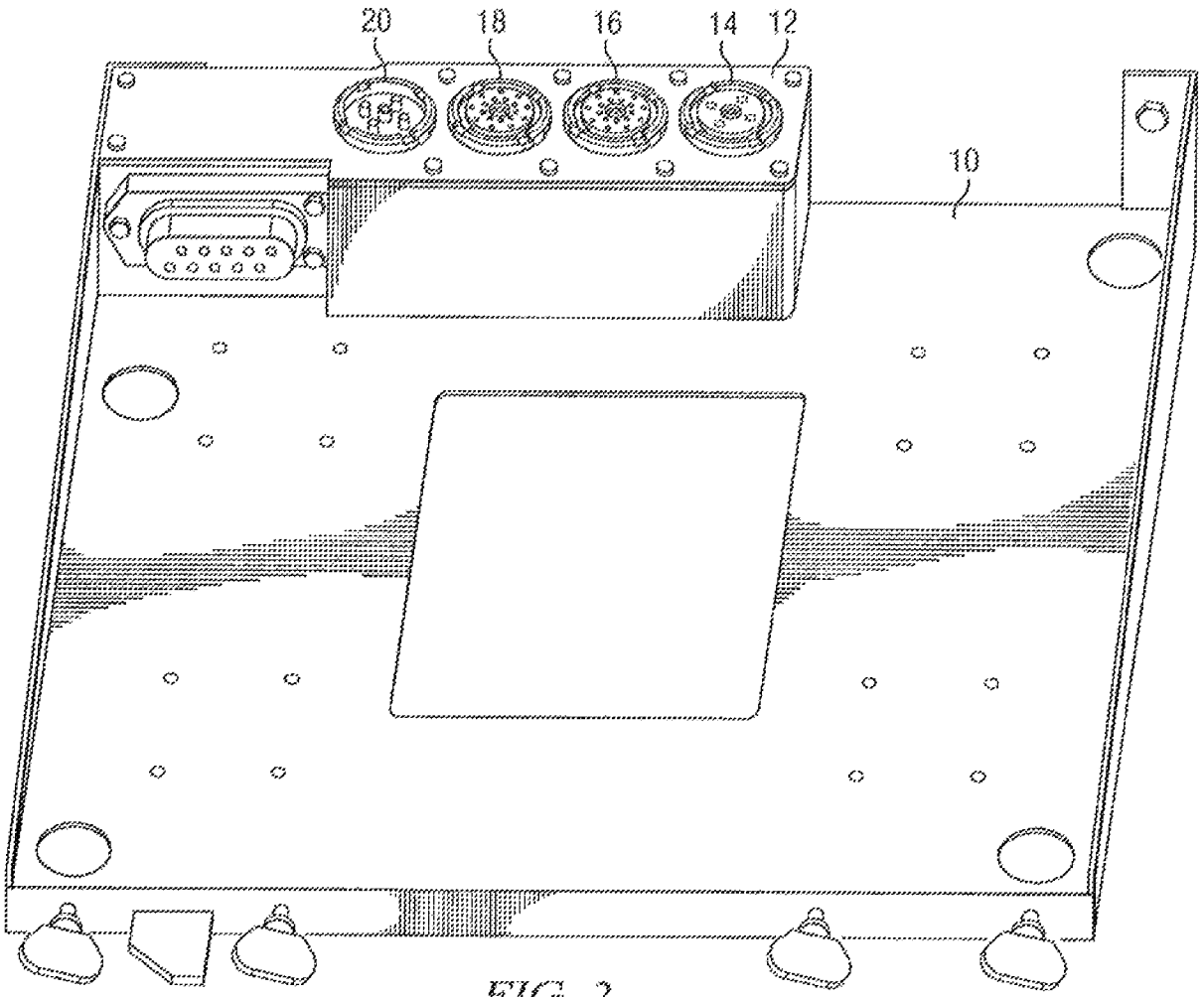
FIG. 2 (PRIOR ART)
FIG. 2 is a perspective view of a vehicular adapter with a power/signal box.

FIG. 5C is a bottom view of the connector 100, showing components housed within the nose piece assembly 106 that are visible from an exterior, according to an exemplary embodiment. The components in the nose piece assembly 106 are configured to be coupled to power output (A4J1) socket 20 of a power/signal box 12 (FIG. 2). The components include a stud 140 and four socket conductors 117. The nose piece assembly 106 includes a central aperture and four socket apertures positioned about the central aperture. The stud 140 is positioned within the central aperture and extends out from the nose piece assembly 106. The stud 140 includes female threads on an interior thereof. The stud 140 is configured to receive a draw screw when coupled to the power output (A4J1) socket 20. Each socket conductors 117 is positioned within one of the socket apertures. When coupled to the power output (A4J1) socket 20, the socket conductors 117 provide an electrical interface with the pin conductors of the power output (A4J1) socket 20.

FIG. 5D also illustrates pin conductors 116 extending from the back of the nose piece assembly 106 (see also FIG. 5A). When the nose piece assembly 106 is assembled in the shell 102 and a cable (not shown) is hard wired via a cable adaptor 110, the wires of the cable may be connected to the pin conductors 116 by any means known to persons of skill in the art so as to transmit power or electrical signals as the case may be.

Figure 6:
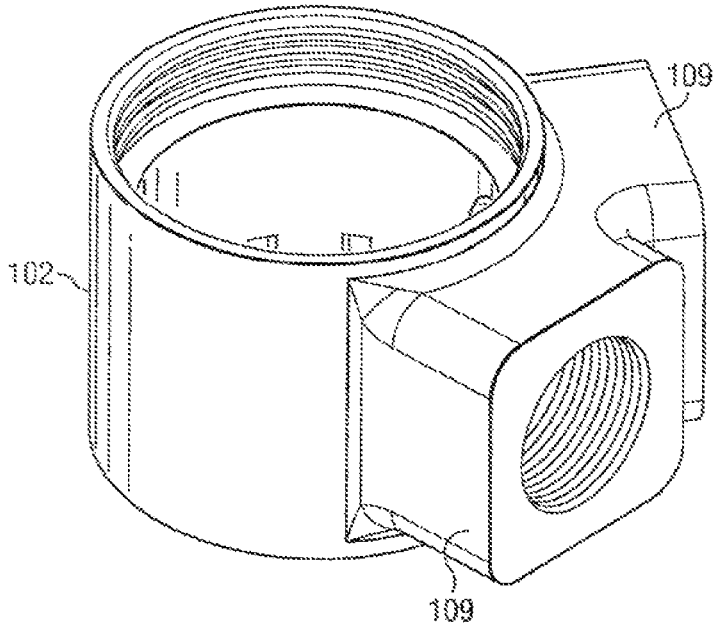
FIG. 6 is a perspective view of a connector having two mounting blocks at an angle of less than 90°.

Referring to FIG. 6, a perspective view of a shell 102 of a connector is shown. The shell 102 is a cylindrical structure and has two mounting blocks 109 extending radially therefrom. In this embodiment, the mounting blocks 109 are positioned so that the angle between the mounting blocks is about 55°. In one embodiment of the invention, the mounting blocks are positioned with an angle of 75° between the mounting blocks. In alternative embodiments, any angle may be used depending on the application, in particular, the angle between the mounting blocks may be between 0° and 180° and in other embodiments the angle may be between 55° and 180°. As shown in FIG. 3, access to the sockets of the power/signal box 12 is limited, such that connectors 100 with differently angled mounting blocks may allow a greater number of power and/or signal cables to connect through the power/signal box 12.

Figure 7:
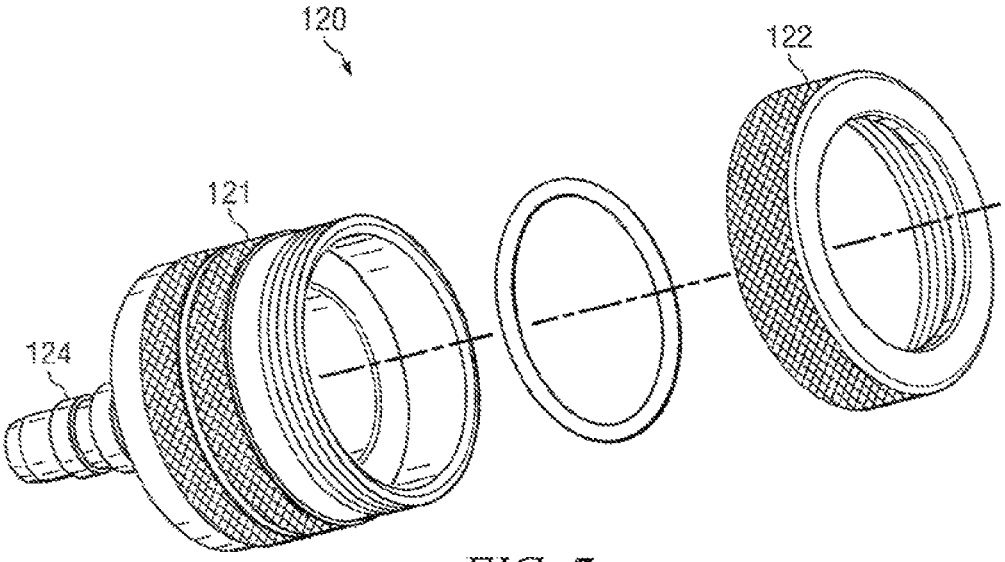
FIG. 7 is an exploded perspective view of a socket/plug housing having a canister, cap and nipple.

FIG. 7 provides a perspective, exploded view of a socket/plug housing 120. The socket/plug housing 120 comprises a canister 121 into which a socket or plug may be inserted. A cap 122 may be threaded onto or otherwise fastened to the canister 121 to hold a socket or plug inside. The cap 122 has a wide hole in its face to provide access to the socket or plug when assembled. A housing o-ring 123 may be positioned between the canister 121 and the cap 122 to seal the connection. A threaded nipple 124 extends from the canister 121 for fastening the socket/plug housing 120 to a mounting block 109. See FIGS. 4A-4B.

Figure 8A:
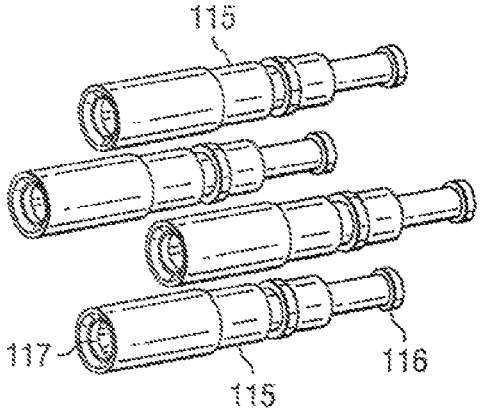
FIG. 8A is a perspective view of conductor studs of a nose piece assembly.
Figure 8B:
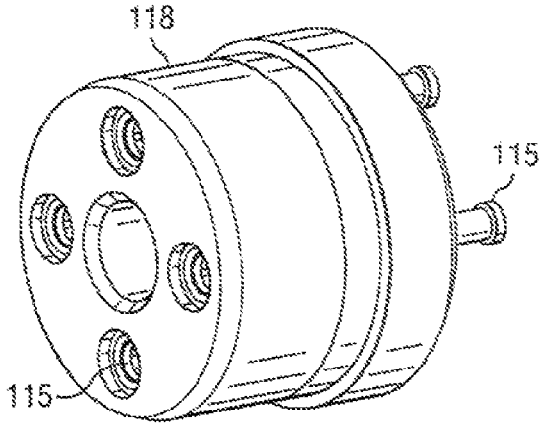
FIG. 8B is a perspective view of a nose piece mandrel with conductor studs assembled therein.
Figure 8C:
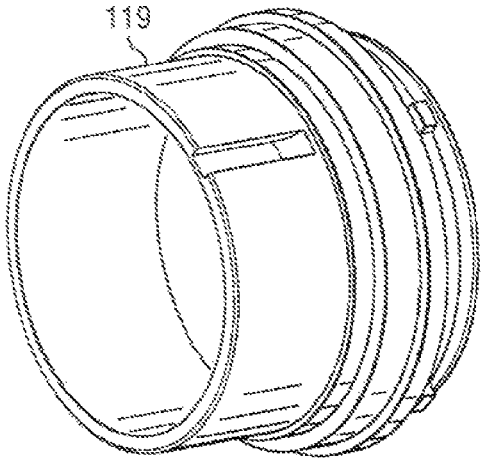
FIG. 8C is a perspective view of a nose piece sleeve of a nose piece assembly.
Figure 8D:
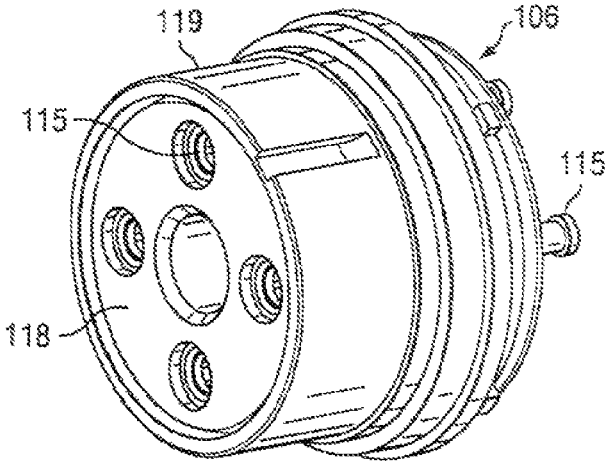
FIG. 8D is a perspective view of an assembled nose piece assembly, wherein the nose piece mandrel is positioned within the nose piece sleeve.

FIGS. 8A-8D provide perspective views of a nose piece assembly 106 in different stages of assembly. This illustrative nose piece assembly 106 has four female socket contacts at its face, but male pin contacts may also be uses. Further, any number of pins or sockets may be configured in the nose piece assembly. FIG. 8A illustrates four conductor studs 115, wherein each conductor stud 15 has a pin conductor 116 at one end and a socket conductor 117 at the opposite end. FIG. 8B shows a nose piece mandrel 118. In this embodiment, the nose piece mandrel 118 has four conductor holes for receiving the four conductor studs 115. The nose piece mandrel 118 also has a center hole, which allows the stud 140 of the handle assembly 103 (see FIG. 5A) to pass through the center of the nose piece mandrel 118. FIG. 8C shows a perspective view of a nose piece sleeve 119, which forms the exterior structure of the nose piece assembly 106. The exterior dimensions of the nose piece sleeve 119 are such that it fits within both the shell 102 (see FIG. 5A) and the canister 121 of the socket/plug housing 120. (See FIG. 7). FIG. 8D illustrates all of the parts of FIGS. 8A 8C assembled together to form the nose piece assembly 106. The nose piece mandrel 118 is positioned inside the nose piece sleeve 119.

Figure 9A:
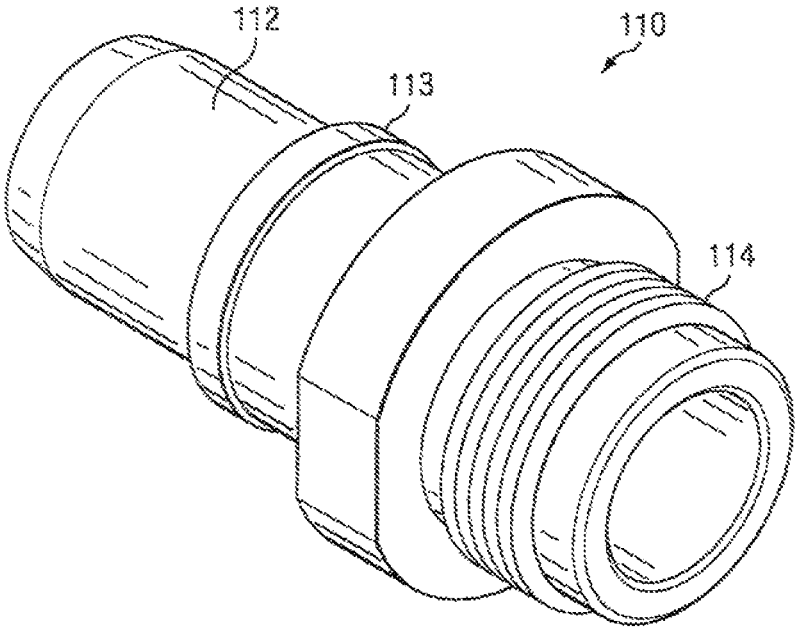
FIG. 9A is a perspective view of a cable adaptor.
Figure 9B:
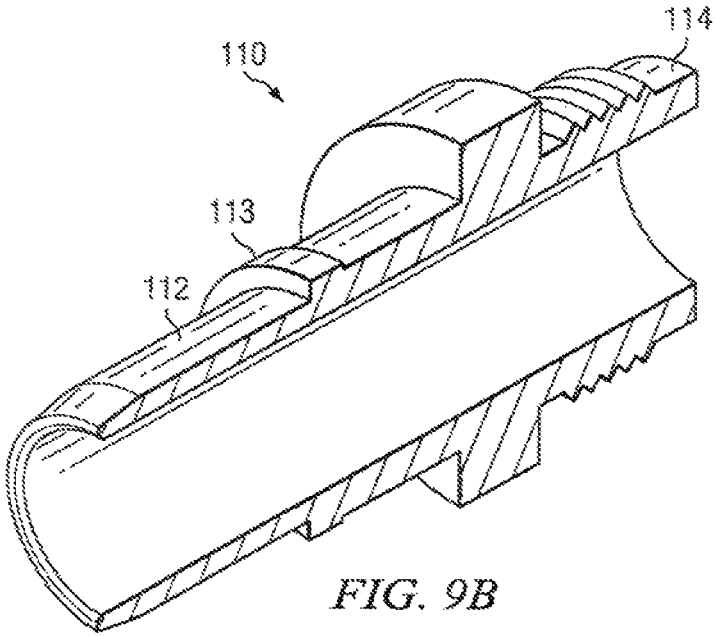
FIG. 9B is a cross-sectional perspective view of the cable adaptor of FIG. 8A, according to an exemplary embodiment.

FIGS. 9A and 9B provide side and perspective views of a cable adaptor 110. The cable adaptor 110 has a threaded nipple 114 for fastening the cable adaptor 110 to a mounting block 109. (See FIGS. 4A-4B). At the opposite end, the cable adaptor 110 has a cable interface 112, wherein the internal wires of the cable may be inserted through the inside of the cable interface 112, and the outer cable insulation or shielding may be pushed over the exterior of the cable interface 112. The outer cable insulation or shielding may be pushed onto the cable interface 112 until it butts against a shoulder 113. Once the cable is fully pushed onto the cable interface 112, the cable may be secured on the cable adapter 110 by a clamp or other device. The cable interface 112 may have a diamond knurl or other abrasive texture to facilitate a secure connection between the cable interface 112 and the insulation or shielding. Further, additional sheath material may be applied over the cable and the cable adapter 110 to further protect the interior wires from weather and the elements. The cable adaptor 110 may be any diameter to accommodate any cable size known in the industry.

Referring again to FIG. 3, a multiple cable connector 100 of the present invention is shown plugged into the power output (A4J1) socket 20 of the power/signal box 12. In this configuration power can be supplied from the power output (A4J1) socket 20 to two different electric components, for example a SINCGARS radio and a GPS navigation system. Prior to use of the invention, the power cable for the SINCGARS radio would be plugged into the power output (A4J1) socket 20. In prior art systems, to supply power to a different electric component via the power/signal box 12, it was necessary to unplug the SINCGARS power cable and then plug in other electric component. In prior art systems, both electric components could not be powered from the power/signal box 12 at the same time. As shown in FIG. 3, the multiple cable connector 100 of the present invention allows two electric components to be powered at the same time via a single power output of the power/signal box 12. The power cable for the SINCGARS radio may be hardwired to the cable adaptor 110 of the connector 100, so that the socket/plug housing 120 is available to be fitted with any nose piece assembly for coupling to a power cable of a second electric component.

Alternatively, the socket/plug housing 120 may be fitted with a nose piece assembly 106 identical to the one in the power output (A4J1) socket 20 of the power/signal box 12, so that when the power cable for the SINCGARS radio is unplugged from the power output (A4J1) socket 20 and the multiple cable connector 100 is plugged into the power output (A4J1) socket 20, the power cable for the SINCGARS radio may be plugged into the socket/plug housing 120. This configuration allows for the power cable of a second electric component to be connected to the cable adaptor 110.

In alternative embodiments, two electric components may be powered by a single power output (A4J1) socket 20 of the power/signal box 12 by hard wiring both cables to cable adaptors 110. Of course, in this embodiment, two cable adaptors 110 are fastened to the two mounting blocks 109 of the connector 100.

In still further embodiments, two electric components may be powered by a single power output (A4J1) socket 20 of the power/signal box 12 by plugging both cables to appropriate nose piece assemblies 106 that are fixed in socket/plug housings 120. In this embodiment, two socket/plug housings 120 are fastened to the two mounting blocks 109 of the connector 100.

While each of the illustrative embodiments disclosed have been described with the connector 100 plugged into the power output (A4J1) socket 20 of the power/signal box 12, alternative embodiments comprise one or more connectors 100 plugged into the power input (A4J2) socket 14, the power output (A4J1) socket 20, the signal output (A4J4) socket 16 and/or the signal output (A4J3) socket 18.

Custom nose piece assemblies 106 may also be fitted into the socket/plug housing 120. In certain alternative embodiments, the nose piece assemblies 106 may include more than four pin or socket conductors 116 or 117 to accommodate a greater number of transmission lines. For example, in certain exemplary embodiments, the nose piece assemblies 106 may include eighteen pin apertures that are configured in two concentric circles of nine pin apertures about the central aperture, each pin aperture housing a pin conductor 116. In certain embodiments, such as in commercial and industrial applications, a variety of contact patterns could be utilized to provide signal or power connections. As a result, the connector 100 offers any number of configurations for virtually any military or industrial need. In certain exemplary embodiments, the pin conductors 116 are constructed from brass. In certain exemplary embodiments, the pin conductors 116 are gold-plated. In alternative embodiments, the pin conductors 116 are constructed from any non-ferrous, conductive material such as copper, brass, phosphor bronze, beryllium copper, and the like.

In a further embodiment of the invention, a connector 100 is equipped with a circuit protector, current limiter, fuse, circuit breaker or other device to limit the current flowing through the connector 100. The connector 100 may be used to protect the power output (A4J1) socket 20 of the power/signal box 12 to prevent two electric components from drawing too much power through the system. For example, the connector 100 may limit the current to 35 amps.

In certain exemplary embodiments, the connector shell 102, the handle assembly 103, and the nose piece assembly 106 are constructed from any material that meets the requirements dictated by the operating environment. In certain embodiments, the connector shell 102 is constructed from aluminum. In certain embodiments, the nose piece assembly 106 is constructed from heat treated steel or aluminum. In certain embodiments, the handle assembly 103 is constructed from heat treated steel or aluminum.

The connector 100 may be a COTS and/or M55181 cable mount connector that is an improvement to those commercially available from Cooper Interconnect. The power source may be a M55181 panel mount connector that is commercially available from Cooper Interconnect. The power source can be any commercially product unit that facilitates the use of the M55181 panel mount style connector. The power source 1090 can be any direct current (DC) power source. In certain embodiments, the power source 1090 is a vehicle battery supply. In alternative embodiments, the invention can also be utilized in alternating current (AC) applications.

Figure 10A:
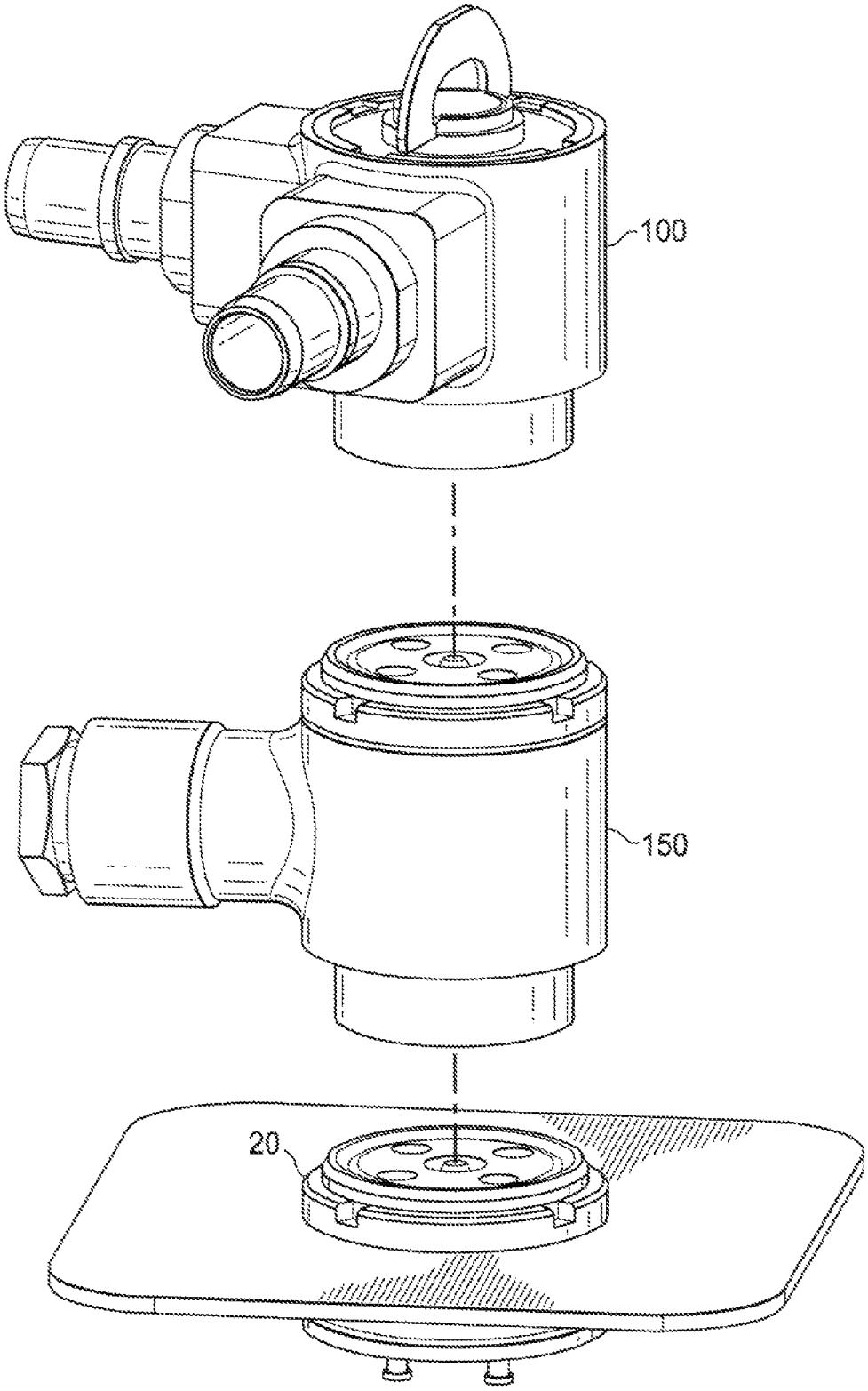
FIG. 10A is an exploded perspective view of a multiple cable connector plugged into a stackable connector, which is plugged into a power output socket.
Figure 10B:
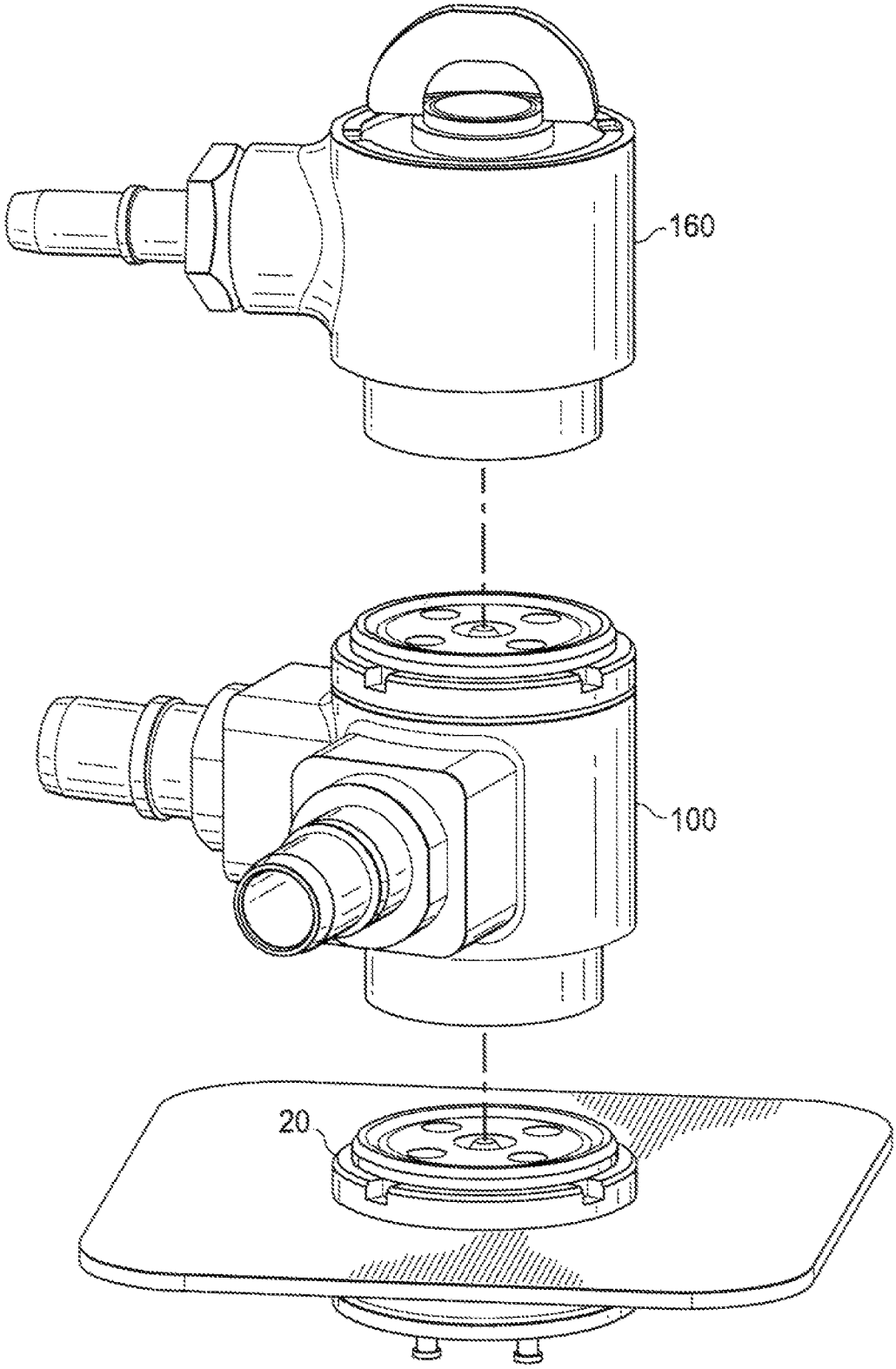
FIG. 10B is an exploded perspective view of a multiple cable connector plugged into a power output socket, wherein the multiple cable connector has stackable functionality, and a single cable connector is stacked on top of and plugged into the multiple cable connector.

In further embodiments of the invention, the multiple cable connector 100 of the present invention may be stacked with other connectors. For example, FIG. 10A shows an exploded perspective view of a stackable connector 150 plugged into a power output socket 20. The figure further shows a multiple cable connector 100 connected to the stackable connector 150. In this configuration, power may be supplied to three different electric components from a single power output socket. FIG. 10B illustrates a further stack embodiment, wherein a multiple cable connector 100 is provided with stackable functionality, so that it is plugged into a power output socket 20, and a single cable connector 160 is plugged into the top of the multiple cable connector 100. In this configuration, power may be supplied to three different electric components from a single power output socket. In a further example, two multiple cable connectors 100 may be stacked to allow power to be supplied to four different electric components from a single power output socket. Alternative stackable configurations are also possible. Stackable connectors are fully disclosed and described in U.S. application Ser. No. 12/920,414 as well as International Publication Number WO 2001/059452 A1, published 19 May 2011, the disclosures of which are hereby incorporated by reference.

Therefore, the present invention is well adapted to attain the ends and advantages mentioned as well as those that are inherent therein. The particular embodiments disclosed above are illustrative only, as the present invention may be modified and practiced in different but equivalent manners apparent to those having ordinary skill in the art having the benefit of the teachings herein. Having described some exemplary embodiments of the present invention, it is believed that the use of alternate connector shell, nose piece assembly, cable adaptor, and socket/plug housing configurations are within the purview of those having ordinary skill in the art. Additionally, while the present application generally illustrates cylindrical nose piece assemblies and connector shells, it is understood that a number of other non-circular configurations may be used. Furthermore, while two mounting blocks are illustrated in association with the shell, three, four, or five mounting blocks may be associated with a single shell to provide power or signal to two-five electric components simultaneously, as limited to current availability and requirements of the system(s) to be powered.

While numerous changes may be made by those having ordinary skill in the art, such changes are encompassed within the spirit of this invention as defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. The terms in the claims have their plain, ordinary meaning unless otherwise explicitly and clearly defined by the patentee.

What is claimed is:

1. A connector comprising:

a shell having a first mounting block and a second mounting block;

a nose piece assembly fastened to one end of the shell;

a handle assembly fastened to an end of the shell opposite the one end to which the nose piece assembly is fastened;

a stud extending from the handle assembly through the nose piece assembly; and one of a cable adaptor and a socket/plug housing fastened to each of the first and second mounting blocks.

2. The connector of claim 1, wherein the shell comprises a cylindrical shape.

3. The connector of claim 1, wherein the first and second mounting blocks extend from the shell forming an angle between about 55° and about 180° between the mounting blocks.

4. The connector of claim 1, wherein the nose piece assembly comprises a power interface.

5. The connector of claim 1, wherein the nose piece assembly comprises a signal interface.

6. The connector of claim 1, wherein the nose piece assembly comprises a stackable nose piece assembly, wherein the connector is stackable with other connectors.

7. The connector of claim 1, wherein the cable adaptor facilitates hard-wiring a cable to the connector.

8. The connector of claim 1, wherein the socket/plug housing comprises a nose piece assembly.

9. The connector of claim 1, further comprising a current limiting circuit, wherein the circuit limits the amount of current flowing through the connector.

10. A connector comprising:

a shell having a first mounting block and a second mounting block;

a nose piece assembly fastened to one end of the shell;

a handle assembly fastened to an opposite end of the shell;

a stud extending from the handle assembly through the nose piece assembly;

a means for securing the connector to a socket;

a means for connecting a cable to the first mounting block; and a means for connecting a cable to the second mounting block.

11. The connector of claim 10, wherein the shell comprises a cylindrical shape.

12. The connector of claim 10, wherein the first and second mounting blocks extend from the shell forming an angle between about 55° and about 180°.

13. The connector of claim 10, wherein the means for securing the connector to a socket comprises a threaded fastener.

14. The connector of claim 10, wherein the means for connecting a cable comprises a means for hard-wiring the cable to the first mounting block.

15. The connector of claim 10, wherein the means for connecting a cable comprises a means for plugging the cable into the first mounting block.

16. The connector of claim 10, further comprising a means for limiting current flowing through the connector.

17. The connector of claim 10, further comprising a means for stacking the connector with other connectors.

18. A communication system comprising:

a vehicular adaptor comprising a power/signal box;

a radio mounted to the vehicular adaptor and comprising a power cable;

a connector comprising:

a shell having a first mounting block and a second mounting block;

a nose piece assembly fastened to one end of the shell;

a handle assembly fastened to an opposite end of the shell;

a stud extending from the handle assembly through the nose piece assembly;

one of a cable adaptor and a socket/plug housing fastened to each of the first and second mounting blocks, wherein the power cable of the radio is electrically connected to the connector via one of a cable adaptor and a socket/plug housing.

19. The communication system of claim 18, wherein the first and second mounting blocks extend from the shell forming an angle between about 55° and about 180° between the mounting blocks and each of the mounting blocks forms an angle of about 90° with a central axis of the shell.

* * * * *